US006376433B1

(12) United States Patent
Connor

(10) Patent No.: US 6,376,433 B1
(45) Date of Patent: Apr. 23, 2002

(54) PROCESS AND PRODUCT FOR LUBRICATING METAL PRIOR TO COLD FORMING

(75) Inventor: Patrick J. Connor, Brighton, MI (US)

(73) Assignee: Century Chemical Corporation, Plainfield, IL (US)

( * ) Notice: Subject to any disclaimer, the term of this patent is extended or adjusted under 35 U.S.C. 154(b) by 0 days.

(21) Appl. No.: 09/614,692

(22) Filed: Jul. 13, 2000

Related U.S. Application Data

(60) Provisional application No. 60/143,442, filed on Jul. 13, 1999.

(51) Int. Cl.[7] ..... C10M 125/00; C10M 129/40

(52) U.S. Cl. ..... 508/163; 508/154; 508/161; 508/390; 508/539; 508/579; 508/583; 72/42

(58) Field of Search ..... 508/154, 161, 508/163

(56) References Cited

U.S. PATENT DOCUMENTS

| | | | | | |
|---|---|---|---|---|---|
| 2,354,072 | A | | 7/1944 | Swift | 83/306 |
| 2,413,220 | A | | 12/1946 | Elder et al. | 72/42 |
| 2,657,156 | A | | 10/1953 | Hyams et al. | 148/260 |
| 2,702,768 | A | | 2/1955 | Hyams et al. | 148/255 |
| 3,775,323 | A | | 11/1973 | Dubourg | 508/162 |
| 3,836,467 | A | | 9/1974 | Jones | 508/143 |
| 3,932,278 | A | | 1/1976 | Meidl et al. | 210/794 |
| 4,029,682 | A | | 6/1977 | Foulks, Jr. | 554/1 |
| 4,130,493 | A | * | 12/1978 | Inoue | 252/28 |
| 4,231,812 | A | | 11/1980 | Paulus et al. | 148/253 |
| 4,427,459 | A | | 1/1984 | Goltz | 148/250 |
| 4,517,029 | A | | 5/1985 | Sonoda et al. | 148/246 |
| 4,622,078 | A | | 11/1986 | Opitz et al. | 148/263 |
| 4,759,861 | A | | 7/1988 | Ogura et al. | 508/390 |
| 5,356,544 | A | | 10/1994 | Zilberman et al. | 508/527 |
| 5,368,757 | A | | 11/1994 | King | 508/232 |
| 5,389,199 | A | | 2/1995 | Awad et al. | 508/150 |
| 5,484,541 | A | | 1/1996 | Przybylski et al. | 508/158 |
| 5,496,479 | A | * | 3/1996 | Videau et al. | 252/49.3 |
| 5,584,945 | A | * | 12/1996 | Nittel et al. | 148/246 |
| 5,624,888 | A | | 4/1997 | Przybylski et al. | 508/161 |
| 5,776,867 | A | | 7/1998 | Przybylski et al. | 508/161 |
| 5,801,129 | A | * | 9/1998 | Damm | 508/175 |
| 6,034,041 | A | * | 3/2000 | Nittel et al. | 508/474 |

OTHER PUBLICATIONS

Technical Data Sheet 1c–1a–for Borax, by United States Borax & Chemical Corporation ©1982; 1992.

Products Data Sheet for Drymet 59, by Crosfield Company, Issue Date; Apr. 1994.

Crosfield Metasilicates catalog, by Crosfield Company, p. 2–3.

Technical Data brochure for C–Lube–16, by Century Chemical Corporation.

Technical Bulletin for Pluracol E 4500 Polyethylene Glycol, by BASF Corporation.

Technical Data brochure for Carbowax Polyethylene Glycols, by Union Carbide–Industrial Chemicals Div. pp. 2–5, 26. 201 1986.

Technical Data brochure for Triton Surfactants–Hydrotropes H–55, H–66 and QS–44, by Union Carbide Chemicals and Plastics Company, Inc.; ©1991.

(List continued on next page.)

*Primary Examiner*—Ellen M. McAvoy
(74) *Attorney, Agent, or Firm*—Young & Basile, P.C.

(57) ABSTRACT

A two- or a one-step process and composition which coats metal workpiece surfaces (aluminum, copper, steel, stainless steel, etc.) with a thin lubricant film capable of allowing the metal to be deformed at room temperature. The lubricant consists essentially of polymers, dispersants, high molecular weight waxes and insoluble metallic stearates. With some ferrous surfaces, a separate coating layer is simultaneously formed (in the one-step process) or pre-formed (in the two-step process) at the metal interface, acting as a base for the lubricant. The process, after pickling in a mineral acid to remove scale and oxides, comprises the step(s) of immersing the workpiece either once or twice. The workpiece is then dried in a heated, forced air dryer.

29 Claims, 6 Drawing Sheets

OTHER PUBLICATIONS

Technical Data brochure for Barium Stearate, by Witco Chemical Corporation.
Technical Data brochure for C–Lube 10, by Century Chemical Corporation.
Technical Data brochure for Lithium Stearate PM, by Witco Chemical Corporation, Organics Division.
Technical Data brochure for Calcium Stearate Regular, by Witco Corporation.
Technical Data brochure for Tamol 960, by Rohm and Haas Company, ©1981.
Product Safety Information for Phosphoric Acid 75%, 80%, and 85%, by Stauffer Chemical Company.
Caustic Soda Handbook, by Vulcan Chemicals pp. 31–33.
Technical Bulletin for Golpanol MBS, by BASF Corporation, Chemicals Division.
Technical Bulletin–Performance review for Golpanol MBS, by BASF Corporation.
MSDS sheet for Borax, by U.S. Borax, Inc. ©1993.
MSDS sheet for C–Lube 16, by Century Chemical Corporation, Prep. date: Jan. 1994.
MSDS sheet for Carbowax Polyethylene Glycol 4600 or 4600 Flake, by Union Carbide Chemicals & Plastics Company Inc.; eff. date: Aug. 1992.
MSDS sheet for Triton H–66 Surfactant, by Union Carbide Chemicals & Plastics Company, Inc. eff. date Oct. 1993.
MSDS sheet for Barium Stearate, by Witco, Organics Division, Rev. Date: Jun. 1989.
MSDS sheet for C–Lube 10, by Century Chemical Corporation, Date prepared: Jan. 1994.
MSDS sheet for Lithium Stearate (all grades), by Witco, Organics Division, Rev. Date: Jun. 1992.
MSDS sheet for Calcium Stearate (all grades), by Witco, Organics Division, Rev. Date: Jun. 1992.
MSDS sheet for Tamol 960 Dispersing Agent, by Rohm and Haas Company, date: Dec. 1993.
MSDS sheet for Sod. Metasilicate, Anh, Drymet, by Emco Chemical Distributors, Inc., Rev. Date: Oct. 1985.
MSDS sheet for Caustic Soda Liquid 50%, by Emco Chemical Distributors, Inc. Rev. Date: Jun. 1985.
MSDS sheet for Colpanol MBS–Sodium–m–nitro benzene sulfate, by BASF Wyandotte Corporation.
MSDS sheet for Metso Beads 2048, by the PQ Corporation, Date: Mar. 1991.
MSDS sheet for Aerosol OS Surfactant, by Cytec, date: Jul. 1997.
Technical Data Sheet for Aerosol OS Surfactant, by American Co. Cyanamid (now Cytec), Date: Mar. 1985.
MSDS sheet for 2001 Cerelose Dextrose Sugur, by Corn Products International., Rec. date: Jun. 1988.
Technical Data Sheet for Foam Ban MS–14M, by Ultra Additives Inc., Rev. Jan. 1994.
MSDS sheet for Rhodafac RA–600 by Rhone–Poulenc, Date: Mar. 1993.
Technical Bulletin for Anionic Surfactant: GAFAC RA–600, by GAF Corporation, ©1972.
MSDS sheet for Magnesium Stearate NF by Witco Chemical Corporatio, Date: Aug. 1994.
MSDS for Sodium Nitrate by Genium Publishing Corporation, Date: Apr. 1982.
MSDS for Sodium Hexametaphosphate by Stauffer Chemical Company, Date: Jun. 1989.
MSDS for Triton H–55 Surfactant by Union Carbide Chemicals and Plastics Company Inc. ©1993.

* cited by examiner

ANALYSIS REPORT

GENERAL CONDITIONS

RESULT FILE : TUBE - A

MICROSCOPE : SEM

COMMENTS :

FIG - 4

ANALYSIS CONDITIONS

QUANT. METHOD : XPP / ASAP

ACQUIRE TIME : 100 SECS

NORMALIZATION FACTOR : 100.00

| ELEMENT | LINE | WEIGHT % | ERROR | K - RATIO | ATOMIC % |
|---|---|---|---|---|---|
| Na | Ka | 4.65 | 0.133 | 0.0061 | 10.21 |
| Si | Ka | 0.54 | 0.024 | 0.0022 | 0.96 |
| P | Ka | 4.62 | 0.064 | 0.0242 | 7.52 |
| S | Ka | 0.41 | 0.018 | 0.0026 | 0.65 |
| K | Ka | 0.10 | 0.008 | 0.0009 | 0.13 |
| Ca | Ka | 0.90 | 0.024 | 0.0088 | 1.13 |
| Mn | Ka | 0.59 | 0.026 | 0.0058 | 0.54 |
| Fe | Ka | 86.76 | 0.337 | 0.8494 | 78.34 |
| Ba | La | 1.43 | 0.057 | 0.0136 | 0.53 |
| TOTAL | | 100.00 | | | |

ANALYSIS REPORT

GENERAL CONDITIONS

RESULT FILE : TUBE - E

MICROSCOPE : SEM

COMMENTS :

FIG - 5

ANALYSIS CONDITIONS

QUANT. METHOD : XPP / ASAP

ACQUIRE TIME : 100 SECS

NORMALIZATION FACTOR : 100.00

| ELEMENT | LINE | WEIGHT % | ERROR | K - RATIO | ATOMIC % |
|---|---|---|---|---|---|
| Na | Ka | 2.47 | 0.106 | 0.0031 | 5.63 |
| Si | Ka | 0.18 | 0.015 | 0.0007 | 0.34 |
| P | Ka | 3.06 | 0.056 | 0.0160 | 5.17 |
| S | Ka | 0.16 | 0.012 | 0.0010 | 0.26 |
| K | Ka | 0.21 | 0.013 | 0.0019 | 0.28 |
| Ca | Ka | 1.49 | 0.033 | 0.0147 | 1.94 |
| Mn | Ka | 0.81 | 0.032 | 0.0081 | 0.78 |
| Fe | Ka | 91.01 | 0.369 | 0.8968 | 85.37 |
| Ba | La | 0.61 | 0.040 | 0.0058 | 0.23 |
| TOTAL | | 100.00 | | | |

CONVENTIONAL ZINC PHOSPHATE PROCESS

RECENT IMPROVED ZINC FREE PROCESS

PRESENT INVENTION " ONE - STEP " EMBODIMENT

PROCESS AND PRODUCT FOR LUBRICATING METAL PRIOR TO COLD FORMING

CROSS-REFERENCE TO RELATED APPLICATIONS

This application claims the benefit of U.S. Provisional application Ser. No. 60/143,442, filed Jul. 13, 1999.

BACKGROUND OF THE INVENTION

The present invention relates generally to a process and product for lubricating metal, particularly to such a process and product used prior to cold forming of the metal, and more particularly to lubrication of ferrous surfaces prior to metal deformation.

Chemical lubricant compositions span a broad range covering metal working fluids and coolants, of both oil and oil-in-water emulsions, and water based "synthetic" mixtures, as well as heavy oils, powders, pastes and greases, which all perform the lubricant functions of reducing contact friction, transferring heat, and allowing a physical or mechanical operation to take place.

"Cold forming" of metal generally entails various work operations at room temperature such as extrusion of metal backward or forward; drawing; ironing; forming; and the like. For example, a metal wire may be drawn to a specific diameter through a die, or metal tubing to a specific wall thickness and diameter over a mandrel, or a metal shape may be formed through a press or heading machine. Each of these operations requires a continual reporting or lubricating layer having good "slip" characteristics, ie. no metal to metal contact, between the tooling and the work piece. The chemical and physical characteristics of this reporting layer determine the feasibility of the extrusion, as well as the tool life.

Presently, the majority of metal parts (such as steel parts) to be cold drawn are prepared with a zinc phosphate coating, and chemically reacted with a buffered sodium stearate lubricant; while in other situations, a zinc phosphate coating is coupled with a combined inorganic or organic lubricant referred to as non-reactive soap coating. For more severe extrusions, the zinc phosphate coated stock may be tumbled with molybdenum disulfide. This metal preparation generally includes the following steps: alkaline cleaning; a hot water rinse; a sulfuric acid pickle; a cold water rinse; a hot water rinse; a zinc phosphate application; a cold water rinse; an alkaline neutralizer; and an application of a reactive organic soap lubricant.

In the steel industry, unlike a layer of paint or oil on the steel surface, the zinc phosphate layer is a conversion coating, which reacts with the base steel and utilizes a portion of it into the coating itself. The resulting precipitation is a mixture of iron from the steel with zinc and phosphate from the phosphate solution which forms zinc-iron phosphate crystals that are chemically bonded to the steel surface. This crystal pattern builds uniformly across the steel surface during immersion in the zinc phosphate bath until a characteristic sparkling grey coating covers the surface. The phosphate coating does not inherently provide lubricity, but it does provide a non-metallic barrier between the steel being extruded and the tools performing the deformation. Although this barrier role is important, the greater function of the zinc phosphate is to retain and react with subsequent carriers and lubricants. These subsequent layers are important for providing relief at critical points of reduction and cold drawing when tools and dies need to allow the passing metal surface to flow freely and smoothly.

The steps involved in the coating deposition are pickling, acceleration, coating and sludge. These steps are repeated each time a clean steel piece enters the solution. After these steps, the steel surface has an anchored crystalline structure thereon which serves two purposes for lubrication. The first purpose is "retention" of lime or stearate soaps, either applied in the pickle/process line or as a dry box lubricant prior to drawing. This is accomplished simply by the physical "sponge" nature of the crystal lattice, which is able to hold large quantities of inorganic lime and/or organic soaps. For some subsequent forming operations, the sheer quantity of retained soap will be the basis for the success of the operation. In other instances, the composition of the retained soap will play the key role. In still other applications, both quantity and composition will be influential. The second purpose is the chemical "reaction" with sodium and calcium stearate soaps. The stearate compounds, via a reactive soap tank or from within a dry box soap, displace the phosphate chemically connected to the zinc and bond directly to the zinc site. This bonded zinc stearate possesses a wide plastic range and high melting point necessary for difficult extrusions.

Current alternatives to the zinc phosphate procedure are oil replacements which are untidy, costly and environmentally unsound, as well as being of only limited effectiveness. In fact, the zinc phosphate procedure itself contains a high concentration of soluble zinc which requires profuse rinsing and subsequent waste water treating and hazardous disposal. Further, a lesser percentage of soluble nickel normally is incorporated into zinc phosphate mixtures, which faces even greater effluent restrictions. Still further, a natural and inevitable byproduct of the zinc process involves the generation of an insoluble, zinc bearing sludge in the process tank itself, which requires periodic solution decants and additional hazardous waste disposal. Yet another drawback lies in the fact that all of the solutions used in the zinc phosphate procedure have a relatively short lifespan in reference to square footage of metal processed and/or weeks of productivity. Desludging and discarding of solutions impede production, add costly labor time to the process, and contribute greatly to waste treatment costs and permanent hazardous disposal sites.

Several years ago, the first water based alternative to this chemical process was discovered and is described in detail in U.S. Pat. No. 5,484,541, which patent is incorporated herein by reference in its entirety. This process utilized water based, non-reactive lubricants and zinc phosphate-free chemical systems. As a result of information derived from utilizing this orthophosphate, acidic solution with either organic or inorganic acceleration (also described in the '541 patent), an industry need became apparent. This need concerns the surface residue from the coating which remains behind after the forming, finishing and stress relieving operations are complete.

The '541 invention deposited a heavy iron phosphate/iron oxide conversion coating on steel surfaces which provided a barrier between tooling and the metal being deformed. This barrier served two purposes: to act as an absorbent layer in order to increase the quantity of the subsequent non-reactive lubricant; and to provide a non-metallic layer in order to cushion the tooling from the part undergoing transformation, which prevents metal to metal contact, scratching and tool wear.

The benefits of this inter-metallic layer, although substantial, have been somewhat offset by its need for eventual removal. This remaining or partially removed, partially thermally degraded coating layer may in some cases cause surface irregularities, discoloration and/or cosmetic rejections, and may also become an eventual corrosion site, even under a rust preventative oil. Consequently, those using this coating system and not subjecting the formed pieces to certain minimal anneal time and temperature cycles, are required to alkaline clean the formed metal surface prior to any further finish processing. This removal is accomplished by means of a special heated alkaline soak immersion step and subsequent neutralized water rinse.

As such, a coating which would achieve the previously described two purposes (absorbency and cushioning), and yet not require removal would improve the efficiency and the economy of the product flow.

Thus, it is an object of the present invention to provide a process and product for lubricating metal prior to cold forming of the metal which is as, if not more effective than current zinc phosphate treatments, while being more efficient and more environmentally sound. Further, it is an object of the present invention to provide such a process and product which does not require profuse rinsing and subsequent waste water treating and hazardous disposal. Still further, it is an object of the present invention to provide such a process and product which does not require periodic solution decants and additional hazardous waste disposal of sludge. Yet still further, it is an object of the present invention to provide such a process and product which has a relatively long lifespan in reference to square footage of metal processed and/or weeks of productivity. Further, it is an object of the present invention to provide such a process and product which would not require cleaning of the formed metal surface prior to any further finish processing; and in fact advantageously provides corrosion resistance to the metal surface when left thereon.

SUMMARY OF THE INVENTION

The present invention addresses and solves the problems enumerated above. The present invention comprises an organic coating/deposit of a substantially powdery texture, loosely adhered to the metal/steel substrate by virtue of a slight metal etch and reaction with an organic, pH neutral solution. This deposit may be applied simultaneously with a lubricant, or alternatively in a pre-lubricant step. This deposit provides an absorbent cushion for lubricant deposition (whether applied prior to, or simultaneously with the lubricant) and metal deformation. The organic coating/deposit is an aqueous solution consisting essentially of a glucose derivative present in an amount sufficient to form a loose, soft and pliable layer of powdery crystals. The glucose derivative forms the greatest constituent within the coating. A meta-phosphate compound is present in an amount sufficient to provide linkage from the organic layer to the metal surface. The coating/deposit further consists essentially of a source of nitrate/nitrite in the form of metallic or alkali earth compounds, in an amount sufficient to provide limited acceleration for the organic deposit. The coating/deposit further optionally consists essentially of an anionic surfactant in an amount sufficient to provide wetting and drainage characteristics to the process solution.

A preferred composition for lubricating a metal workpiece prior to cold forming consists essentially of at least one aqueous alkaline stearate compound adapted to, and present in an amount sufficient to impart metal lubrication between about 180° F. and about 320° F.; at least one aqueous alkaline palmitate compound adapted to, and present in an amount sufficient to impart metal lubrication below about 160° F.; at least one aqueous metallic stearate compound adapted to, and present in an amount sufficient to impart metal lubrication between about 240° F. and 320° F.; at least one polymeric glycol adapted to, and present in an amount sufficient to provide temperature stability, act as a carrier for the aqueous compounds, and impart a waxy lubrication to the metal; at least one hydrotropic agent adapted to, and present in an amount sufficient to solubilize the lubricating composition; and at least one stabilizing agent adapted to, and present in an amount sufficient to maintain solution stability among soluble constituents and to provide dispersing and suspending action among insoluble constituents. The lubricating composition further consists essentially of a dispersing agent for maintaining the aqueous compounds in solution; and a polyelectrolyte for imparting a cohesive film strength to the lubricating composition as it is dried on the metal workpiece.

The present invention further comprises a process for preparing/chemically coating/layering a metal workpiece outer surface prior to or simultaneous with lubrication and prior to subsequent cold forming, the process comprising the step of disposing an organic coating/deposit of a substantially powdery texture on the workpiece outer surface, the outer surface having been alkaline cleaned, hot water rinsed, acid pickled, and cold water rinsed. The first step of alkaline cleaning may sometimes be omitted if the incoming metal/steel is oil free.

BRIEF DESCRIPTION OF THE DRAWINGS

Other objects, features and advantages of the present invention will become apparent by reference to the following detailed description and drawings, in which:

FIG. 4 is a table showing the elemental breakdown for tube a);

FIG. 5 is a table showing the elemental breakdown for tube e);

DETAILED DESCRIPTION OF THE PREFERRED EMBODIMENTS

Figure 1:
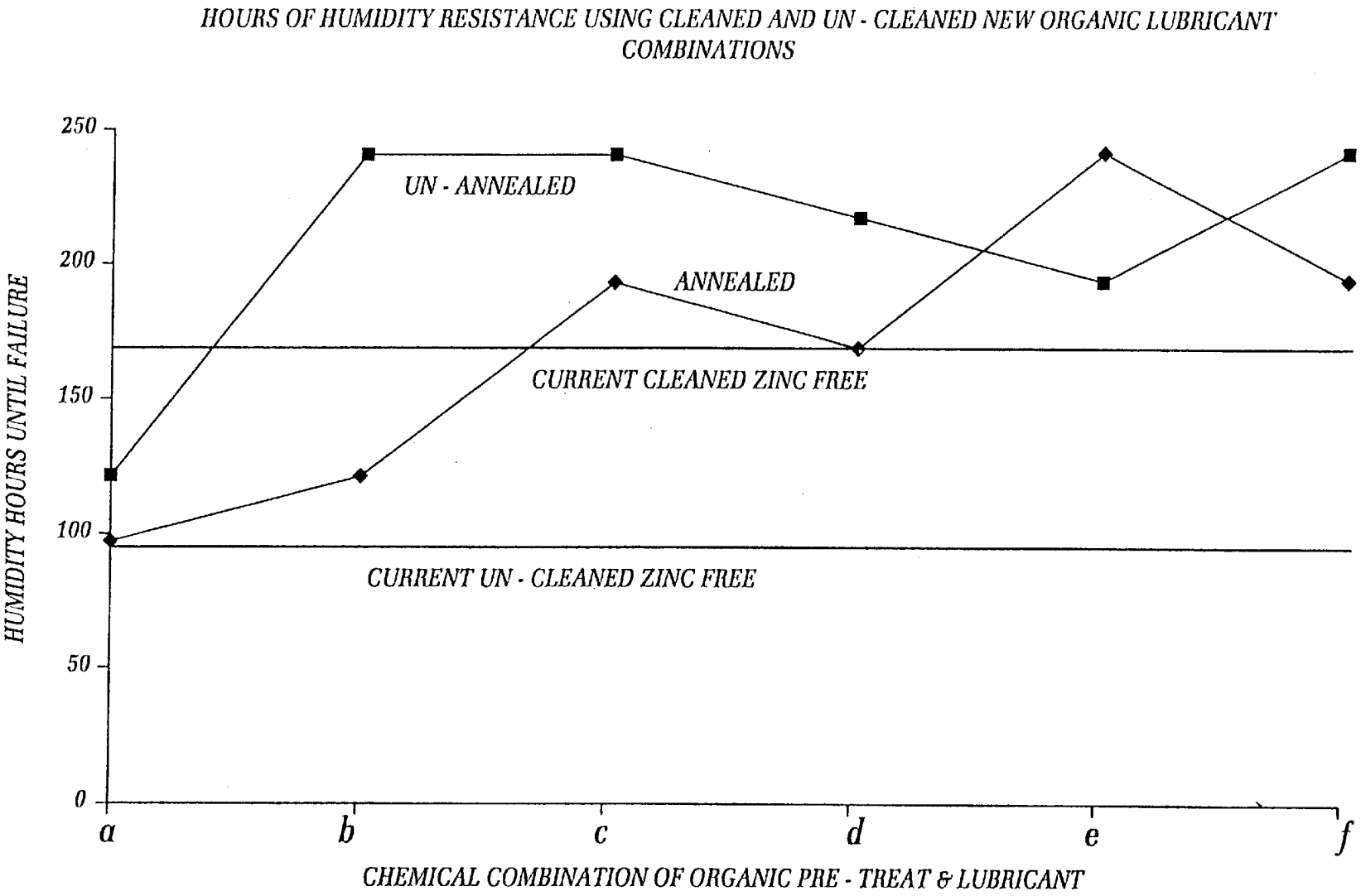
FIG. 1 shows the hours of humidity resistance of cold formed tubes with each chemical combination a through f, both annealed and un-annealed, as well as showing the hours of humidity resistance of cold formed tubes cleaned after zinc free lubrication and un-cleaned after zinc free lubrication.

The present invention comprises an aqueous solution capable of producing a coating on metal surfaces which consists of an organic layer designed to act as a pretreatment base for a water based lubricant.

The product referred to is a powder blend of inorganic and organic salts, which is mixed and dissolved in hot water. Metal parts, eg. steel and stainless steel parts, tubes, rod and wire are then immersed in the solution for a short time cycle, whereby a mixed organic-inorganic coating is produced. This solution operates at a neutral pH, but nonetheless provides a light etch on the steel surface. Dissolved iron is re-deposited into an organic complex and allowed to precipitate back onto the surface. This coating is not water rinsed, but followed by a secondary immersion into a lubricant solution. According to the present invention, the coating may also be mixed with the lubricant solution; thereby forming a one-step coating/lubricating process.

It is believed that the coating may be essential to the performance of the cold forming operation, as it affords maximum absorption of the subsequent lubricating layer, as well as forming an insulating barrier between the metal being drawn or formed and the tooling performing the operation.

As such, the present invention comprises a pre-lubricant, organic coating/deposit of a substantially powdery texture, loosely adhered to the metal/steel substrate by virtue of a slight metal etch and reaction with an organic, pH neutral solution. This deposit provides an absorbent cushion for subsequent lubricant deposition and metal deformation. The coating which provides this necessary barrier is largely organic in nature, but in its initial formation consists of a phosphorus compound bonded to both the ferrous surface and to an oxygen atom of an organic compound. This organic deposition then continues quickly until the coating ceases to grow after it reaches about 5 to 6 gm/m$^2$.

Without being bound to any theory, it is believed that the relatively small percentage of the coating which consists of the phosphorus compound may be necessary to provide linkage for the greater quantity of organic compound which rapidly deposits. The coating is irregular in nature, but remains bonded to the steel surface after immersion in the next stage of hot lubricant.

During metal deformation, the coating mixes with the subsequent lubricant layer and provides the metal to metal slip required for cold drawing. It eventually melts and collapses.

The coating deposited is largely organic in composition, with the phosphate group only playing a role in initial surface reaction. The solution which produces such a mixed phosphorus-organic coating on metal/steel is an aqueous solution which operates at a pH range between about 6.5 and about 8.0 and temperatures ranging from about 150° F. to about 190° F.; and consists essentially of the following components.

A glucose derivative is present in an amount ranging between about 70 grams/liter to about 125 grams/Liter. This component forms the greatest constituent within the coating. Many sugar compounds would be effective, however, in the preferred embodiment, dextrose is used. One such suitable dextrose compound is commercially available from Corn Products International in Englewood Cliffs, N.J. under the tradename 2001 CERELOSE (as described in the MSDS therefor dated May 1972, which is incorporated herein by reference in its entirety).

A meta-phosphate compound provides linkage from the organic layer to the steel surface. Many phosphate salts could be used here, however, in the preferred embodiment, sodium hexa-meta phosphate is used. This is present in a quantity ranging from about 60 to about 140 grams/liter.

A source of nitrate/nitrite in the form of metallic or alkali earth compounds provides limited acceleration for the organic deposit. Many nitrate salts have been effective here, however, in the preferred embodiment, sodium nitrate is used. The nitrate/nitrite is present in a quantity ranging from about 12 to about 32 grams/liter.

When the coating/deposit is used in the two-step process as disclosed herein, a complexing agent may be optionally provided for soluble iron chelation and precipitation back into the coating. Preferred compounds are salts of ethylene diamine tetra-acetic acid in a quantity ranging between about 8 and about 24 grams/liter. It is to be understood that many suitable complexing agents may be used; however, in the preferred embodiment, a chelating agent is used which is commercially available from Dow Chemical in Midland, Mich. under the tradename VERSENE 220 POWDER CHELATING AGENT.

An anionic surfactant provides wetting and drainage characteristics to the process solution. Preferred selections are ethoxylated alcohols or alkyl phenols with an HLB number from about 9.0 to about 12.0. This concentration is desirable in a range between about 6 and about 20 grams/Liter. One suitable anionic surfactant is commercially available from Niacet Corporation in Niagara Falls, N.Y. under the tradename NIAPROOF Anionic Surfactant 08. Another suitable anionic surfactant is commercially available from Union Carbide Corporation, Specialty Chemicals Division located in Danbury, Conn. under the tradename TERGITOL 08.

This mixture comprises a homogeneous solution with a desired operating pH between about 7.2 and about 7.8; and temperatures ranging from about 150° F. to about 190° F.; preferably between about 170° F. to about 180° F.; and more preferably at about 185° F. The neutral working pH provides a non-hazardous, noncorrosive blend, which is advantageous both within the process tanks and for ease with waste treatment as well. This combination of components effectively coats steel surfaces in a quantifiable amount measured by stripping a coated surface in a hot chromic acid solution. Typical immersion times of about two minutes produce a deposit calculated to be between about 3 grams/meter$^2$ and about 4 grams/meter$^2$. This in turn is capable of absorbing subsequent non-reactive lubricant in quantities from about 4 to about 5 grams/meter$^2$.

The present invention further comprises a composition for lubricating a metal workpiece prior to cold forming. This inventive lubricating composition consists essentially of an aqueous alkaline stearate compound adapted to, and present in an amount sufficient to impart metal lubrication between about 180° F. and about 320° F. It is to be understood that any suitable alkaline stearate compound may be used, however, in the preferred embodiment, this alkaline stearate compound is selected from the group consisting of sodium stearate, calcium stearate, and mixtures thereof. These compounds may be added in any suitable weight percentage, however, the concentration of the sodium stearate compound ranges between about 24 and about 48 grams/liter. A preferred concentration is about 36 grams/liter. It is to be understood that various equivalent compounds may be substituted for the sodium stearate, which is a sodium salt of a carboxylic acid bearing 18 carbons. One such equivalent includes sodium salts of 14 carbon bearing carboxylic acids (myristic acid) and 16 carbon bearing carboxylic acids (palmitic acids). Further equivalents include potassium salts of the same 14, 16 and 18 carbon designations.

It is to be understood that any suitable alkaline stearate compound having lubrication between about 180° F. and 320° F. may be used. One such suitable compound is known as C-LUBE 10 commercially available from Century Chemical Corporation in Plainfield, Ill. C-LUBE 10 is a sodium stearate, and it is to be understood that other sodium stearates may be used. It is a non-hazardous stearate soap less than about 100% by weight. Its solubility in water at 160° F. is 150 g/l. It is an off-white, free-flowing powder with a bland odor. It is a stable compound.

The calcium stearate may also be added in any desired and suitable weight percentage, however, in the preferred embodiment, the concentration ranges between about 14 and about 28 grams/liter, with a preferred concentration at about 20 grams/liter. It is to be understood that the composition of the present invention contemplates various equivalent structures suitable for use herein. Of these, it is contemplated that calcium salts of 14 carbon bearing carboxylic acids (myristic acid) and calcium salts of 16 carbon bearing carboxylic acids (palmitic acid) are suitable. Further, magnesium salts of the same designation are also suitable alternatives.

An example of a suitable calcium stearate compound is commercially available from Witco Chemical Corporation of Chicago, Ill., under the trade name Calcium Stearate Regular. Its moisture has a maximum of 2.5%; the total ash is between about 9.0% and about 10.5%; the free fatty acid has a maximum of 2.0%; the fineness through 325 mesh is 99.0%; the typical apparent density is 24 lb/ft$^3$. The chemical name is octadecanoic acid, calcium salt. Its formula is $(C_{17}H_{35}COO)_2Ca$. It appears as a white powder having a slight fatty odor. Its specific gravity is 1.03 and its melting point is 320° F. Its solubility in water is negligible and it is stable under normal conditions.

The lubricating composition of the present invention further consists essentially of an aqueous alkaline palmitate compound adapted to, and present in an amount sufficient to impart metal lubrication below about 160° F. It is to be understood that this palmitate compound may comprise any suitable compound. However, in the preferred embodiment, sodium palmitate is used. It is to be understood that this compound may be present in any suitable weight percentage, however, in the preferred embodiment, the concentration ranges between about 24 and about 48 grams/liter, and still more preferred, 26 grams/liter. It is to be understood that various equivalent structures are also contemplated in the present invention, and any such suitable structures may be used. Some suitable alternatives include the sodium salts of 14 carbon bearing carboxylic acids (myristic acid). Further alternates include potassium salts of the same 14 and 16 carbon designations.

It is to be understood that any suitable sodium palmitate may be used; however, in the preferred embodiment, one such compound used is commercially available from Century Chemical Corporation in Plainfield, Ill. under the trade name C-LUBE 16. This is a non-hazardous stearate soap less than about 100% by weight. Its solubility in water at 160° F. is 240 g/l. It appears as an off-white, free-flowing powder with a bland odor. It is a stable compound.

The lubricating composition of the present invention further consists essentially of an aqueous metallic stearate compound adapted to, and present in an amount sufficient to impart metal lubrication between about 320° F. and about 440° F. It is to be understood that any suitable compound may be used, however, in the preferred embodiment, this metallic stearate compound is selected from the group consisting of barium stearate, lithium stearate, and mixtures thereof. It is to be understood that the barium stearate compound may be present in any suitable weight percentage, however, in the preferred embodiment, the concentration ranges between about 24 and about 60 grams/liter, with a preferred concentration of about 44 grams/liter. It is to be understood that various alternative compounds are contemplated for use in the present invention, and may successfully be used herein of these, the barium salts of both the 14 and 16 carbon chain carboxylic acids may successfully be employed. Further alternates include aluminum salts of the same 14, 16 and 18 carbon designations.

An example of a suitable barium stearate is commercially available from Witco Chemical Corporation in Chicago, Ill. The barium stearate moisture percentage is a maximum of 1.0; the total ash percentage at 750° C is between about 28.0 and 30.0; the free fatty acid has a maximum of 1.0%; and the fineness through 200 mesh is 99.0%. The chemical name is barium stearate-barium soap. The formula is $Ba(OOCC_{17}H_{35})_2$. It appears as a white powder having a slight fatty odor. Its specific gravity is 1.23, and its melting point is 320° F. Its solubility in water is negligible.

It is to be understood that the lithium stearate may be present in any suitable weight percentage. In the preferred embodiment, the concentration ranges between about 20 and about 60 grams/liter, with a preferred concentration of 26 grams/liter. It is to be understood that various suitable alternate structures are contemplated as being capable for successful use in the present composition. Among these suitable alternates are the lithium salts of the 14 and 16 carbon chain carboxylic acids. Other suitable alternates may include the aluminum salts of the same 14, 16 and 18 carbon designations.

An example of a suitable lithium stearate compound is commercially available from Witco Chemical Corporation in Chicago, Ill. and available under the trade name lithium stearate PM. Its maximum moisture is 1.0%; the lithium content is between about 2.4% and about 2.6%; the free fatty acid is not more than 0.5%; the free alkalinity is not more than 0.02%; and the fineness through 200 mesh is 99.0%; and through 40 mesh is 100.0%. Its chemical name is lithium salt of commercial stearic acid. Its formula is $LiC_{18}H_{35}O_2$. It appears as a white powder having a slight fatty odor. Its specific gravity is 1.01 and its melting point is 414° F. It is insoluble in water.

The lubricating composition of the present invention further includes a polymeric glycol adapted to, and present in an amount sufficient to provide temperature stability, act as a carrier for the aqueous compounds, and impart a waxy lubrication to the metal. It is to be understood that any suitable polymeric glycol may be used; however, in the preferred embodiment, this glycol is selected from the group consisting of polyethylene glycol, polypropylene glycol, and mixtures thereof. These polymeric glycols may be of any suitable molecular weight. However, in the preferred embodiment, this molecular weight ranges between about 400 and about 8000, more preferably between 2000 and 4600, and still more preferably this polymeric glycol has a molecular weight between about 4500 and about 4600. In the preferred embodiment, PEG 4500 is used. This is the polyethylene glycol having a molecular weight of 4500. It is to be understood that the polymeric glycol may be present as any suitable weight percent of the present lubricating composition; however, in the preferred embodiment, the concentration is between about 10 and about 30 grams/liter, with a preferred concentration of about 24 grams/liter.

An example of a suitable polymeric glycol is commercially available from Dow Chemical U.S.A. in Midland, Mich. under the trade name POLYGLYCOL E4500. This is a hard, white, wax-like solid, soluble in water. Its chemical formula is $HO(C_2H_4O)_{101}C_2H_4OH$. Its average molecular weight is 4500, and its viscosity at 210° F. is 170 cs. Its freezing point is 58° C., and its specific gravity at 25° C. is 1.224. Its color (APHA), 25% in water is 10–20. It has a neutral pH, and its ash content is nil.

Another suitable polymeric glycol is commercially available from Union Carbide Corporation located in Danbury, Conn. under the trade name CARBOWAX POLYETHYL- ENE GLYCOL 4600. Its average molecular weight ranges between about 4400 to 4800. Its pH in a 5% aqueous solution at 25° C. ranges between 4.5 and 7.5. In a 25% aqueous solution, the water solubility indicates a solution free from haze or turbidity. The viscosity at 210° F. ranges between 150 and 210 cst.

Another suitable polymeric glycol is commercially available from BASF Wyandotte Corporation in Wyandotte, Mich. under the trade name PLURACOL E4600. This is a polyethylene glycol having an average molecular weight of 4600.

The lubricating composition of the present invention further consists essentially of a compound adapted to, and present in an amount sufficient to act as a carrier for the aqueous compounds and to provide a translucent film barrier on the metal. It is to be understood that this compound may be any suitable compound; however, in the preferred embodiments, this compound is a sodium tetraborate. The sodium tetraborate, ie. BORAX, used may be either 5 or 10 mole (waters of hydration). It is to be understood that this may be present in any suitable weight percentage of the lubricating composition, however, in the preferred embodiment, the concentration ranges between about 36 grams/liter and about 120 grams/liter, with a preferred concentration between about 54 and about 108 grams/liter, and still more preferred is about 54 grams/liter. It is to be understood that various alternates may successfully be employed. Of these, it is contemplated that potassium tetraborate may be used.

It is to be understood that any suitable compound may be used which acts as a carrier for the aqueous compounds and provides a translucent film barrier on the metal. In the preferred embodiment, a sodium tetraborate compound is used. One such suitable compound is commercially available from United States Borax and Chemical Corporation in Los Angeles, Calif. under the trade name BORAX 5-MOL. Its chemical name is sodium tetraborate pentahydrate. It comes from the borate chemical family. Its CAS number is 1330-43-3, and its formula is $Na_2B_4O_7.5H_2O$. It is a white, odorless crystalline solid having a specific gravity of 1.815 and a melting point of 200° C. It is 3.60% soluble in water at 20° C. and 50.13% soluble in water at 100° C. When dissolved in water, hydration to the decahydrate takes place. The pH of a 3% solution at 20° C. is 9.25. It is a stable compound.

The lubricating composition of the present invention further comprises an alkaline buffering agent adapted to, and present in an amount sufficient to provide dispersion, viscosity and stability. It is to be understood that any suitable alkaline buffering agent may be used, however, in the preferred embodiment, sodium metasilicate anhydrous is used. This is also known as SMS anhydrous. One such suitable compound is commercially available from Rhone-Poulenc, Inc. in Cranberry, N.J. under the tradename DRYMET. It is to be understood that this may be present in any suitable weight percentage; however, it is preferred that the concentration ranges between about 5 and about 12 grams/liter, and still more preferably the sodium metasilicate is present at about 8 grams/liter. It is to be understood that suitable alternates may be used in the present invention. Of these, it is contemplated that potassium silicates, other alkaline salts such as trisodium phosphate (TSP) and tetrasodium polyphosphate (TSPP) will function with suitable buffering capabilities. SMS crystalline may also be used; however, when using a compound such as CRYSTAMET®, it would be necessary to use about 1.74 lb. of it to every 1 lb. of the anhydrous material in order to obtain an equivalent amount in solution.

It is to be understood that any suitable sodium metasilicate may be used. One such suitable sodium metasilicate is commercially available from the PQ Corporation located in Valley Forge, Pa. under the trade name METSO BEADS® 2048 anhydrous sodium metasilicate. Its chemical name is silicic acid, disodium salt. This compound appears as odorless, white granules having a bulk density of 68 lbs/ft$^3$ untamped. The solubility in water is appreciable, and the pH is 13 to 14—water solutions are very alkaline. The product is stable, but incompatible with hot water and concentrated acids.

A suitable crystalline sodium metasilicate is commercially available from Rhone-Poulenc, Inc. in Cranberry, N.J. under the trade name CRYSTAMET® sodium metasilicate, pentahydrate. A synonym is silicic acid, disodium salt. Its formula is $Na_2SiO_3.5H_2O$, and its molecular weight is 212.14. It is a white granular solid having a loose bulk density of approximately 55 lbs/st$^3$. It is 61 g/\100 g soluble in water at 86° F., and its pH is 12.4 in a 1% aqueous solution.

Another suitable sodium metasilicate is commercially available from EMCO Chemical Distributors, Inc. in North Chicago, Ill., while the producer is Diamond Shamrock Chemical Company in Irving, Tex. The chemical name is silicic acid, disodium salt. Its trade name and synonyms are SMSA, SPECIAL 25, ANHYDROUS METASILICATE. Its CAS Reg. No. is 6834-92-0. It is 100% sodium silicate and it may be treated as caustic. Typical physical data include a vapor density of 2.4 g/ml at 77° F. It is 18% soluble in water and appears as a white granular or powdered solid having no odor. The compound is stable under ambient conditions. The material is alkali in nature and is not compatible with strong acids.

The lubricating composition of the present invention further comprises a hydrotropic agent adapted to, and present in an amount sufficient to solubilize the lubricating composition. It is to be understood that any suitable hydrotropic agent may be used. This hydrotropic agent aids in preventing the soluble and insoluble components of the present invention from separating into a diphase solution. In the preferred embodiment, a potassium salt of phosphate ester is used. The hydrotropes may be present in any suitable amount; however, in the preferred embodiment, the concentration ranges between about 5 and about 24 grams/liter, and more preferably at about 10 grams/liter. It is to be further understood that various alternate compounds may be used. For example, TRITON H-55, also commercially available from Union Carbide, may be used. Further, phosphate esters, such as RHODAFAC RA-600, manufactured by Rhone-Poulenc, in Marietta, Ga. (as described in the MSDS therefor dated Mar. 18, 1993, which is incorporated herein by reference in its entirety); GAFAC RA-600, commercially available from GAF Corporation Chemical Division in New York, N.Y. (as described in technical bulletin 9655-023 entitled GAFAC RA-600 Anionic Surfactant, dated 1972, which is incorporated herein by reference in its entirety); RA-610 and generic equivalents may be used. Still further, other chemical hydrotropes such as sodium xylene sulfonate (SXS) (Steppan-Steppanate X) and generic equivalents may be used.

It is to be understood that any suitable hydrotropic agent may be used. One such suitable compound is commercially available from Union Carbide Chemicals and Plastics Company, Inc. in Danbury, Conn. under the trade name TRITON H-66 Surfactant. Its chemical name is alkyl aryl alkoxy potassium salt. A synonym of this is a phosphate ester potassium salt anionic surfactant. Typical physical characteristics include a boiling point at 760 mm Hg of 213° F., and a specific gravity of 1.256. Its freezing point is −6° F., and its vapor pressure at 20° C. is 13.38 mm Hg. Its evaporation rate is 0.93, and its vapor density is 1.20. It is 100% soluble in water at 20° C., and its appearance is transparent yellow. It has a pungent odor and is a liquid. Its percent volatiles is 50% by weight. Its ingredients include 50% of a phosphate ester potassium salt, and 50% water. It is a stable compound.

Another suitable hydrotropic agent is TRITON® H-55. This is a phosphate ester potassium salt having a clear, light-amber liquid appearance. The specific gravity at 25° C. is 1.35, while the viscosity at 25/25° C. is 40 cP. The density at 25° C. is 11.2 lb/gal. The pH ranges between 8 and 10. It is stable in acidic and alkaline solutions, but may undergo slow hydrolysis in neutral solutions. In dry mixes, it will remain sufficiently stable if used in direct contact with solid caustic. It is soluble in water and water-miscible solvents, but insoluble in less polar solvents.

The lubricant of the present invention is a water-based mixture of insoluble and soluble ingredients, physically agitated and chemically dispersed, which lends to uniform coating of insoluble components. When deposited on the metal surface to be lubricated, this layer is simply disposed upon the surface rather than the previous lubricant layers which had actually reacted with the metal surface.

The lubricating composition of the present invention may further consist essentially of a dispersing agent for maintaining the aqueous compounds and solutions; and a polyelectrolyte for imparting a cohesive film strength to the lubricating composition as it is dried on the metal workpiece. It is to be understood that any suitable dispersing agent and polyelectrolyte may be used. In the preferred embodiment, one compound serves both functions. This compound is a sodium salt of polymeric carboxylic acid, such as TAMOL 960. It is to be understood that separate suitable compounds performing each of the functions may be used, as well as an alternate compound which may perform both functions. It is to be understood that any suitable weight percentage may be used. In the preferred embodiment, the concentration ranges between about 0.25 and about 12 grams/liter, with a preferred concentration of 8 grams/liter. It is to be understood that any suitable equivalent compound may be used. It is contemplated that ammonia or potassium salts of the same acids (TAMOL 961), as well as sodium and ammonia salts of naphthalene sulfonic acids (TAMOL SN 819) may successfully be employed.

TAMOL® 960 is commercially available from Rohm and Haas Company located in Philadelphia, Pa. This compound is the solution of the sodium salt of a carboxylated acrylic polyelectrolyte. This is an efficient dispersant for kaolin clay. TAMOL® 960 is a primary dispersant in the pH range 6–10. It is also a secondary dispersant, providing excellent heat-aging stability to pre-dispersed clay slurries. Typical properties of this compound include the following. It appears as a clear liquid and has a solids content of 40%. The pH as packed at 25° C. is 7.0–9.0, generally 7.0. The Brookfield LVS Viscosity at 25° C. (#2 spindle, 30 rpm) is 300–800 cps., generally 550 cps. The color (APHA) is 200 max. The specific gravity at 25° C. is 1.0–1.275, generally 1.275. The density at 25° C. is 10.63 lb/U.S.gal. The solubility is infinite in water. The TAMOL® 960 contains 39–41% of the sodium salt of polymeric carboxylic acid; less than 0.1% of individual residual monomers; not more than 0.07% formaldehyde (CAS Reg. number 50-00-0); and 59–61% water. The material is considered stable, however, at temperatures above about 350° F., polymer decomposition begins.

Without being bound to any theory, it is believed that the use of a organic dispersing agent in the present invention, such as, for example, the TAMOL 960, may also encapsulate the metallic stearates at room temperature. Soluble barium compounds are regulated and limited to 100 ppm total leachable barium using the EPA toxicity procedure. Therefore, since the dispersing agent may be encapsulating the barium, the barium has been found to be non-leachable at room temperature. Thus, any barium used (if present in the lubricating composition at all) is insoluble and non-hazardous in the process tank, and, when eventual disposal of the lubricant composition of the present invention may be required, the solidified lubricant composition may be discarded as non-hazardous waste. Further, since any contaminants introduced into the process tank containing the lubricant composition during metal lubrication has not shown any interference with the performance of the lubricant of the present invention, it appears that, as opposed to being relatively short as with the lubricant compositions of the prior art, the life span of the lubricant composition of the present invention is quite long, if not indefinite.

In the more preferred embodiment, the lubricating composition of the present invention consists essentially of the above-mentioned components, but with the carrier for the aqueous compounds, for example, a sodium tetraborate compound eliminated. Also eliminated from the more preferred lubricating composition is the alkaline buffering agent, for example, sodium metasilicate. The more preferred, organic based lubricant is devoid of these alkaline salts which provided (in the lubricating composition above-described) a suitable alkaline base for the solid metallic stearates. However, it has been found that upon drying within the applied lubricant film, these components could in some instances re-gain their waters of hydration, especially in high humidity conditions. This moisture could cause the metal/steel being drawn to skid and chatter through the die in a potentially unacceptable manner, unless re-drying was afforded.

It has unexpectedly and advantageously been discovered that, even when using the above-mentioned lubricating composition having these alkaline salts, the problem mentioned immediately above may be substantially improved and/or eliminated when the alkaline-assisted lubricating composition is used in conjunction with the organic coating/deposit of the present invention, either in a one-step process (coating and lubricating composition in one tank); or in a two-step process (coating applied first, lubricating composition applied subsequently).

In the more preferred embodiment of the lubricating composition, it was unexpectedly and advantageously found that the high molecular weight glycol (eg. a molecular weight preferably between about 2000 and about 8000, with a molecular weight of about 4400–4600 being more preferred) and/or a mixture of high molecular weight glycols were well suited to stand alone as carriers for the metallic stearates in lieu of the eliminated soluble alkaline, deliquescent salts.

The more preferred, all organic based lubricant consists essentially of insoluble metallic and alkaline stearates within an all organic carrier base. The carrier base is one or a mixture of high molecular weight polyethylene glycols, in the presence of one or more dispersants/solubilizers. The organic based lubricant further consists essentially of a stabilizing/suspending agent.

Some non-limitative examples of the carrier base include, but are not limited to high molecular weight glycols selected from the group consisting of polypropylene glycol, polyethylene glycol, methoxy polyethylene glycol, and mixtures thereof. These polymers may have varying molecular weights ranging between about 2000 and about 8000; and more preferably between about 4400 and about 4600. Some suitable examples of polyethylene glycols include those commercially available from Union Carbide Corporation, Specialty Chemicals Division located in Danbury, Conn. under the trade name CARBOWAX Sentry PEG series, numbered with their molecular weight, eg. 2000, 4600, 8000, etc.

In the more preferred embodiment of the lubricant, barium has also been eliminated. This advantageously renders the lubricant even more environmentally friendly and eliminates any toxicity concerns which had been linked with the use of barium.

The components of the more preferred embodiment of the lubricating composition essentially are: a) insoluble, dispersible solids: metallic stearates, with melting points ranging from about 170° F. to about 420° F. (salts of Magnesium, Calcium, Lithium and Sodium); b) organic carriers: one or more polyethylene glycols of high molecular weight (4500 and 8000 gram atomic weight); c) one or more dispersants and/or solubilizers; and d) one or more stabilizer/suspending agents. The all organic, more preferred lubricant may further optionally consist of one or more de-foaming agents.

In the most preferred embodiment, the organic conversion coating/deposit of the present invention, specifically the glucose derivatives, in combination with the all organic (minus the alkaline salts) lubricant composition is used in either a one-step process (preferably); or a two-step process.

It is to be understood that the present invention contemplates the following non-limitative variations: the inventive organic coating/deposit as a layer prior to any subsequent lubricating composition, either in a one- or two-step process; the inventive organic coating/deposit as a layer prior to the alkaline-assisted lubricating composition described further hereinabove, either in a one- or two-step process; the inventive organic coating/deposit as a layer prior to the all organic, more preferred lubricating composition described further hereinabove, either in a one- or two-step process; and/or any combination of the above.

It is also to be understood that the alkaline-assisted lubricating composition and/or the all organic, more preferred lubricating composition of the present invention may in some instances (especially in less difficult forming operations) be satisfactorily used without any pre-treatment conversion coating/deposit.

Both of the lubricating compositions of the present invention use water soluble components as a carrier for the insoluble ingredients, as well as a lubricant at low temperatures. These soluble components, which may preferably include, but are not limited to, sodium salts of stearic and palmitic acid, provide a film plasticity on the surface which precedes metal movement in the early milliseconds of metal forming, i.e. wherein the metal temperature is below 200° F. The use of a polymeric glycol, which preferably has a high molecular weight, functions in a like manner, in that it is a waxy material at temperatures above 200° F. and provides a thin, pasty coating as metal is pulled through a die or header. The insoluble ingredients, which preferably include, but are not limited to, calcium stearate, barium stearate and lithium stearate are uniformly dispersed and begin to melt and lubricate at temperatures above 200° F. The residual coating after one extrusion is usually present in sufficient quantity to allow another metal reduction without reapplying fresh lubricant. The chemical dispersion is achieved with a small concentration (between about 3 and about 8 grams/liter in the alkaline assisted lubricant; and up to about 24 grams/liter in the all organic lubricant) of a sodium salt of a carboxylated acrylic polyelectrolyte. This ingredient, although optional, is quite advantageous, especially for use with difficult forming operations, such as forming a hex head out of a round shaped metal. During extrusions such as this, it is believed that the above-mentioned sodium salt is important for maintaining the necessary dispersion in conjunction with the polyglycol. This sodium salt compound may be added as a separate component into a process tank, and may or may not be premixed with the main lubricant composition. For example, once either of the lubricant compositions of the present invention is dissolved in a process tank in concentrations as disclosed herein, after a process temperature between about 148° F. and about 158° F. is reached, the sodium salt compound may be added. It is further believed that the resulting film strength and uniformity of the coated steel may be related to this sodium salt dispersing agent. The mechanism for lubricant deposition is a physical one. As mentioned further above, it is not a chemically reactive lubricant. Either of the lubricant compositions of the present invention, with its soluble and insoluble components, is deposited on the metal during the immersion in solution. The water is removed by a dryer before any extrusion operation. A forced hot blow off achieves complete drying, normally accomplished by placement in a 200° F. to 275° F. dryer for approximately 15–20 minutes.

Without being bound to any theory, it is further believed that the uniformity and quantity of lubricant deposited may be enhanced by pre- or simultaneous-treatment of the metal (for example, steel) surface with the resulting organic conversion coating/deposit of the present invention. It appears that the pickled steel surface, without such a pre-treatment conversion coating, may at times be too irregular and too inconsistent for sufficient quantities of lubricant, especially when severe extrusions are called for. The application of this organic conversion coating produces coatings at a pH range of at least about 7.0 of more than 200 mg/ft$^2$ to 500 mg/ft$^2$. It is believed that this is important for successful severe extrusions.

Without being bound to any theory, it is believed that the many advantageous aspects of the lubricating compositions of the present invention are a result of the blend of aqueous alkaline stearate and palmitate compounds, polymeric glycols, and insoluble, dispersed metallic stearates having mixed melting points. It is believed that further advantages stem from the present invention's water based, non-oil system. The steel drawing and extrusion industry prefers not to apply and transfer oiled steel parts when a water base dried-in-place lubricant film is available, such as the lubricating composition of the present invention.

Further advantages of the process of the present invention include the savings in time as compared to a typical prior art zinc phosphate process. The process of the present invention has far fewer steps and does not involve the hazardous waste and sludge removal as outlined further hereinabove relative to the prior art process. The process according to the present invention comprises the steps of four (or three, if steps 3) and 4) are combined) chemical immersion stages:

| 1) mineral acid pickle | 2) cold water rinse | 3) organic coating/ deposit | 4) non-reactive lubricant |
|---|---|---|---|

Immersion times for the final 2 stages are 2 minutes per stage, rather than the conventional 16 minutes with a conventional zinc phosphate system. Further, if steps 3) and 4) are combined, the immersion time for the combined step is 2 minutes, which saves a further 2 minutes from the four step process of the present invention.

Solutions 3 and 4, being of similar pH, are advantageously compatible, and can in fact successfully and operatively be mixed in one tank (the "one-step" process as described herein). When a "two-step" process, drag-in from tank 3 to tank 4 is not a problem issue. Longevity of solutions is indefinite, contrasted to fixed decanting and dump schedules with traditional zinc phosphate systems.

Processed bundles have no storage "shelf" life restrictions, as opposed to current processes which can be affected by atmospheric moisture.

A further advantage of the present invention is water conservation. Since the process tanks are run an average of 15° F. to 30° F. lower than conventional tanks, less water is lost through evaporation. Further, since fewer tanks are used due to the fewer steps in the inventive process, including less rinsing, much less water is used, fewer tanks need to be charged and disposed of, and tanks containing the inventive composition need to be disposed of less often. This results in a water savings of up to millions of gallons per year.

The clean water act of 1990 requires heavy metal discharges to be limited to lesser values. The nickel and zinc present in the zinc phosphate are both subjected to these restrictions. In addition, air borne zinc stearate is not only a nuisance dust but also is limited by NIOSHA and OSHA to 10 and 15 mg/m$^3$, respectively. These restrictions are advantageously met with the present invention. Pollution prevention is designed to stop pollution at its source point. This is precisely what is achieved with the case of substituting the present inventive product(s) and process(es) for the conventional zinc phosphate.

The so called "plastic" state of a film is the pasty range of the substance whereby it is neither solid nor liquid. A coating which will suffice in many operations will arrive at its plastic state at a relatively low temperature and maintain some degree of plasticity for an extended period. Therefore, combinations of different melting point lubricants, as in the lubricating composition of the present invention, can play an instrumental role in a heading operation with multiple blows. When one component of a lubricant is expended and higher temperatures are reached, another component can enter its plastic state for the remaining blows.

The particle size and dispersion of the insoluble components of the present invention are an important aspect regarding the lubricant film's uniformity and distribution. Agitation in the lubricant process tank, i.e. the tank whereby the solution is dissolved and ready to receive the metal to be lubricated, is important. In the process of the preferred embodiment, a system whereby the lubricant solution in the process tank is pumped from the bottom of one or both ends of the process tank and then recirculated back through a series of nozzled horizontal pipes near the solution level is generally very effective.

Figure 8A:
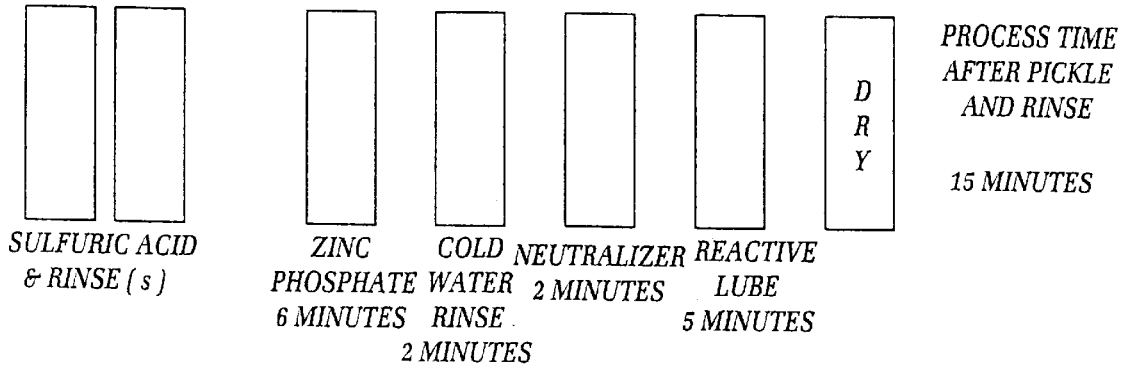
FIGS. 8A, 8B and 8C depicts the process time differences between that of a conventional zinc phosphate process; a zinc free process; and the process of the present invention.
Figure 8B:
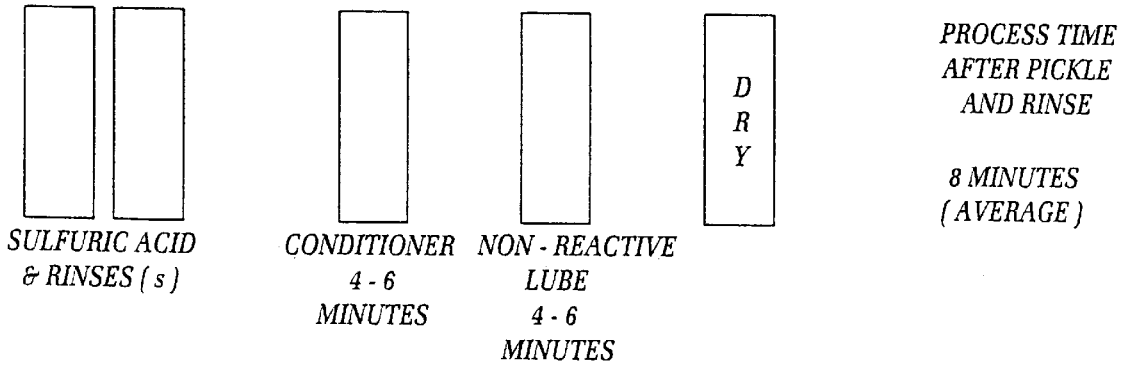
Figure 8C:
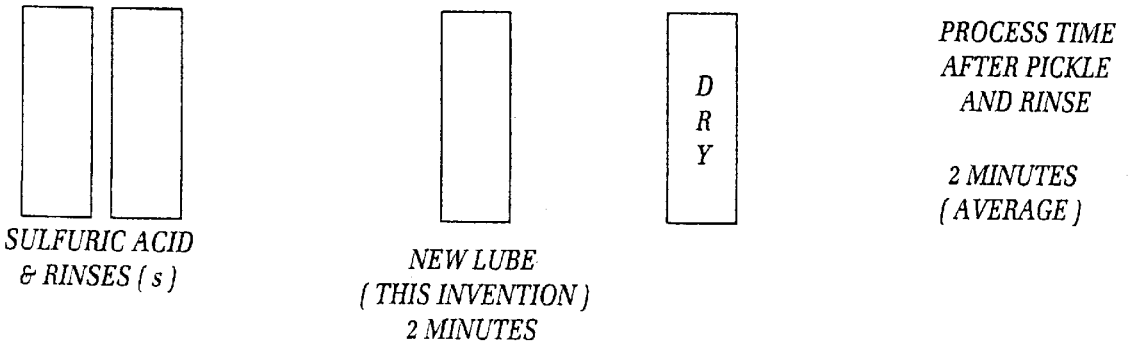

FIGS. 8A, 8B and 8C depicts the process time differences between that of a conventional zinc phosphate process; the zinc free process as defined in U.S. Pat. No. 5,484,541; and the one-step embodiment of the process of the present invention. As can be seen, savings in process time is one of the many advantages of the present invention. There are also savings in energy costs (fewer tanks to heat), as well as reductions in water usage for make-up and evaporative loss. That is, the zinc phosphate process requires that three of the four stages depicted be heated to an average of 175° F. The second process requires both of its stages to be heated to that average 175° F., whereas the one-step embodiment process of the present invention has only one tank heated to that temperature range.

Further, there is no additional rinsing necessary, as required with the zinc phosphate process. There is also only one tank calling for water replenishment due to evaporative loss as opposed to three (zinc phosphate process) and two (non-reactive process) respectively. Thus, there is further advantageous water conservation in the one-step embodiment.

When the two-step process is employed, the quantity of components in the organic conversion coating (ie. the glucose derivative, the meta phosphate and the nitrate/nitrite accelerator) may be used at higher concentrations than when employed in the one-step process. It is believed that this is due to a slight dissolution of the organic layer during the initial immersion within the lubricant tank, prior to lubricant absorption. These higher solution concentrations afford a slightly greater deposition of the organic coating so as to offset that quantity which is solubilized in the lubricant.

Thus far, the primary application for the one-step coating/all organic lubricant has been on ferrous surfaces (steel, steel alloys, stainless steel). Though the coating mechanism would be by pure physical deposition, the proposed lubrication system may be suitable for other metals as well. These include but are not limited to aluminum, aluminum alloys, copper and copper alloys.

To further illustrate the present invention, the following examples are given. It is to be understood that these examples are provided for illustrative purposes and are not to be construed as limiting the scope of the present invention.

EXAMPLES 1–6

These two technologies, namely the organic conversion coating; and the organic base lubricant with insoluble metallic stearates were combined and evaluated in the following manner to compare one another as well as existing zinc free technology.

Applied in two separate chemical immersion stages:

a) Inorganic conversion coating (as disclosed in U.S. Pat. No. 5,484,541) and alkaline assisted lubricant;

b) Organic conversion coating and alkaline assisted lubricant;

c) Organic conversion coating and all organic base lubricant;

Applied in one chemical immersion stage:

d) Combined organic conversion coating and alkaline assisted lubricant;

e) Combined organic conversion coating and all organic base lubricant; and f) All organic base lubricant without any base conversion coating.

After each of the above lubricants a) through f) was applied to steel tubing, the tubing was dried at 240° F. for 30 minutes. All of these combinations were successful in cold drawing the tubes over mandrels.

The inventive organic conversion coating and combinations thereof are intended to eliminate the cleaning need (as mentioned hereinabove)—that is, to allow the coating after drawing and prior to final stress relieve to not require removal and to not pose accelerated oxidation problems. In order to measure the success of the present inventive coating/lubricant, drawn samples of finished steel tubing, oiled (some cleaned and some uncleaned, some stress relieved and some not stress relieved), were subjected to 1000 humidity testing until failure.

The testing was as follows: Eight foot sections of 1026 grade steel with starting diameter of 1.990" and wall thickness of 0.284" were drawn over mandrel down to a finish diameter of 1.50" and finish wall of 0.219". The process would then typically proceed to the alkaline cleaning stage, neutralization, heat treat, straightening, cut to length and end finish and finally rust preventative oil. However, the process was deliberately altered in order to measure the effect of eliminating the alkaline cleaning step.

The accelerated corrosion testing consisted of five chemical combinations and three distinct production processes. The objective was not only to successfully draw the tubes with each chemical combination, but to eliminate the cleaning process for both annealed and un-annealed requirements. The humidity testing was conducted in accordance with ASTM specification D 2247 (100° F., 95–100% relative humidity). Testing was considered a failure when 5% or greater of the steel surface was rusted. Hours in the humidity cabinet prior to failure are recorded in the tables below.

Using the standard process, that is with an alkaline cleaner, all five new chemical combinations performed exactly as did the current zinc free process. Essentially all the surfaces cleaned up completely and the humidity resistance was due entirely to the rust protective oil covering a clean steel surface:

Standard production process (all parts immersed in alkaline cleaner for 4 minutes, sodium nitrite bearing hot water rinse for 2 minutes, no final anneal, then oiled):

| | Hours of Humidity testing until failure: | | | | | |
|---|---|---|---|---|---|---|
| | a | b | c | d | e | f |
| hours | 168 | 168 | 168 | 168 | 168 | 168 |

Process variation 1 (all parts not cleaned in alkaline cleaner cycle, no final anneal, then oiled):

| | Hours of Humidity testing until failure: | | | | | |
|---|---|---|---|---|---|---|
| | a | b | c | d | e | f |
| hours | 96 | 120 | 192 | 168 | 240+ | 192 |

Process variation 2 (all parts not cleaned in alkaline cleaner cycle, annealed and oiled):

| | Hours of Humidity testing until failure: | | | | | |
|---|---|---|---|---|---|---|
| | a | b | c | d | e | f |
| hours | 120 | 240 | 240 | 216 | 216 | 240+ |

The conclusion drawn from these results is as follows. It is possible that by not cleaning the all organic coating, the rust preventative capability of the finished and oiled tube has actually been aided. That is, by eliminating the time consuming and costly step of alkaline cleaning, the present invention has actually improved the finished appearance and corrosion resistance of the drawn tube.

The graph of FIG. 1 shows the hours of humidity resistance with each chemical combination. In all cases with the un-annealed samples, every variation outperformed the current alkaline cleaned process. With the annealed samples, only variation b (organic pre-coat with the alkaline assisted lubricant) showed weaker humidity performance than the cleaned samples. This variation still vastly outlasted the current technology if it were allowed to be annealed uncleaned.

As such, it has been shown that there is actually an advantage in eliminating the alkaline cleaning step with any of the inventive organic combinations, and in fact even if the inventive organic lubricant is used on a stand alone basis, there remains some rust resistant residue after drawing.

It has also been found that this coating can be used on alloy and stainless steels, with the same combinations producing successful drawing. Even when there is no possibility of rusting (as with stainless steel), the drawn coating can be easily removed for cosmetic and appearance reasons.

Figure 2:
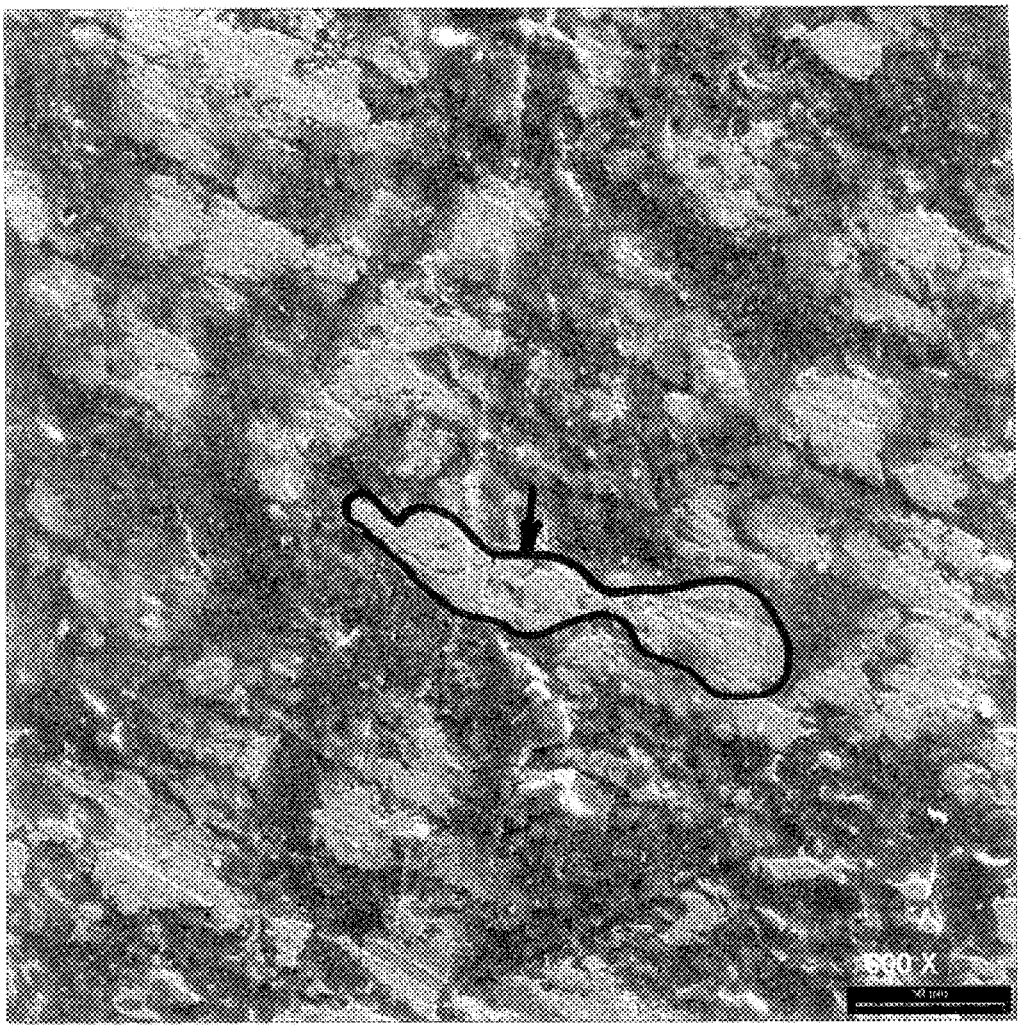
FIG. 2 is a scanning electron microscope photograph at 600X showing tube a) after drawing and after anneal.
Figure 3:
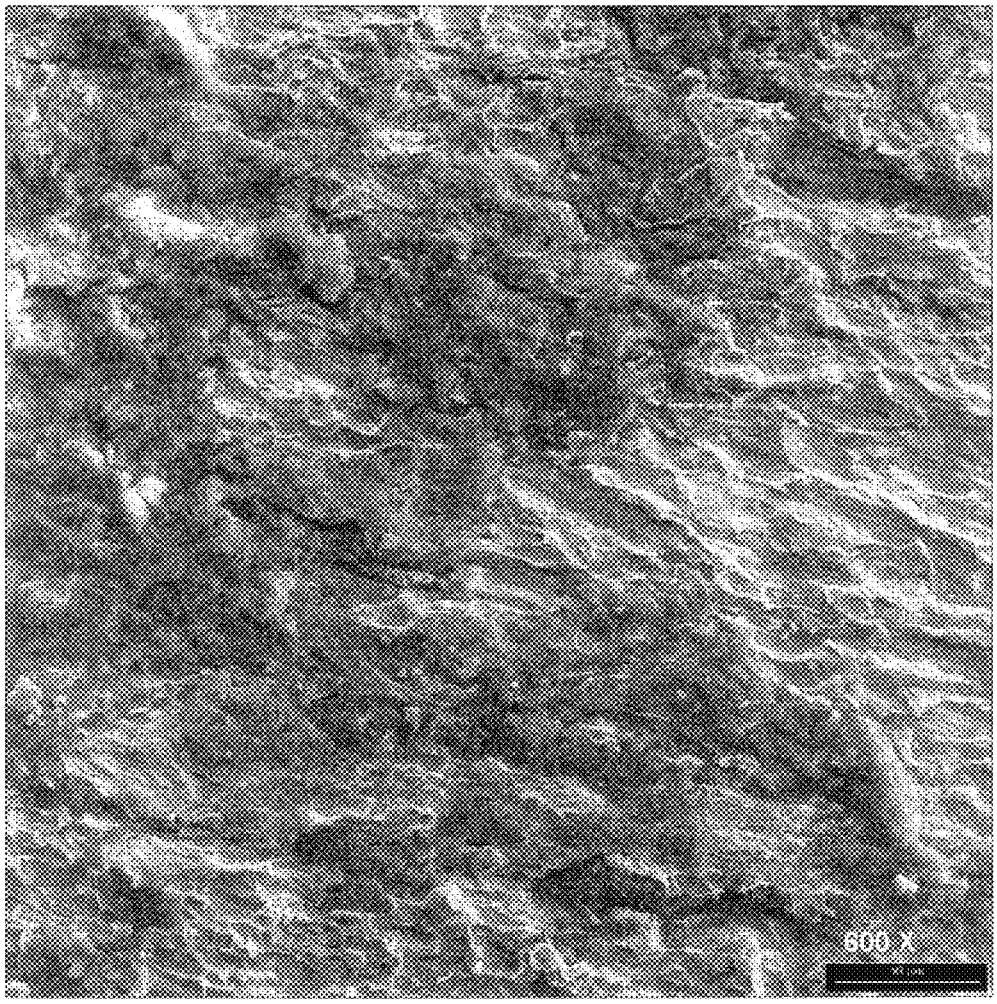
FIG. 3 is a scanning electron microscope photograph at 600X showing tube e) after drawing and after anneal.

SEM-EDS data were also taken for the tubing treated as in a) and in e) above. FIG. 2 is a scanning electron microscope photograph at 600X showing tube a) after drawing and after anneal. FIG. 3 is a scanning electron microscope photograph at 600X showing tube e) after drawing and after anneal. The elemental breakdown for tube a) is shown in the table in FIG. 4; while the elemental breakdown for tube e) is shown in the table in FIG. 5. The circled and arrowed surface area of FIG. 2 shows one of the areas of degraded iron phosphate coating, which could be a possible site for future corrosion. This residual performs the poorest in extended humidity testing. FIG. 3 shows no such surface areas, indicating the unlikelihood of possible future corrosion sites. This residual performed the best in accelerated humidity testing.

As for the elemental breakdown, there is a possibility of error, depending on the depth of the probe. If the probe is inserted deeper on one sample than on another sample, the iron peak would increase. The presence of Si in FIG. 5 is most probably due from residual water, as there is no silicate in the lubricating composition tested in FIG. 5. Also, the presence of P is from the sodium hexa-meta phosphate in the organic coating/deposit—it is not bonded, but rather is simply laying in the coating/deposit.

Figure 6:
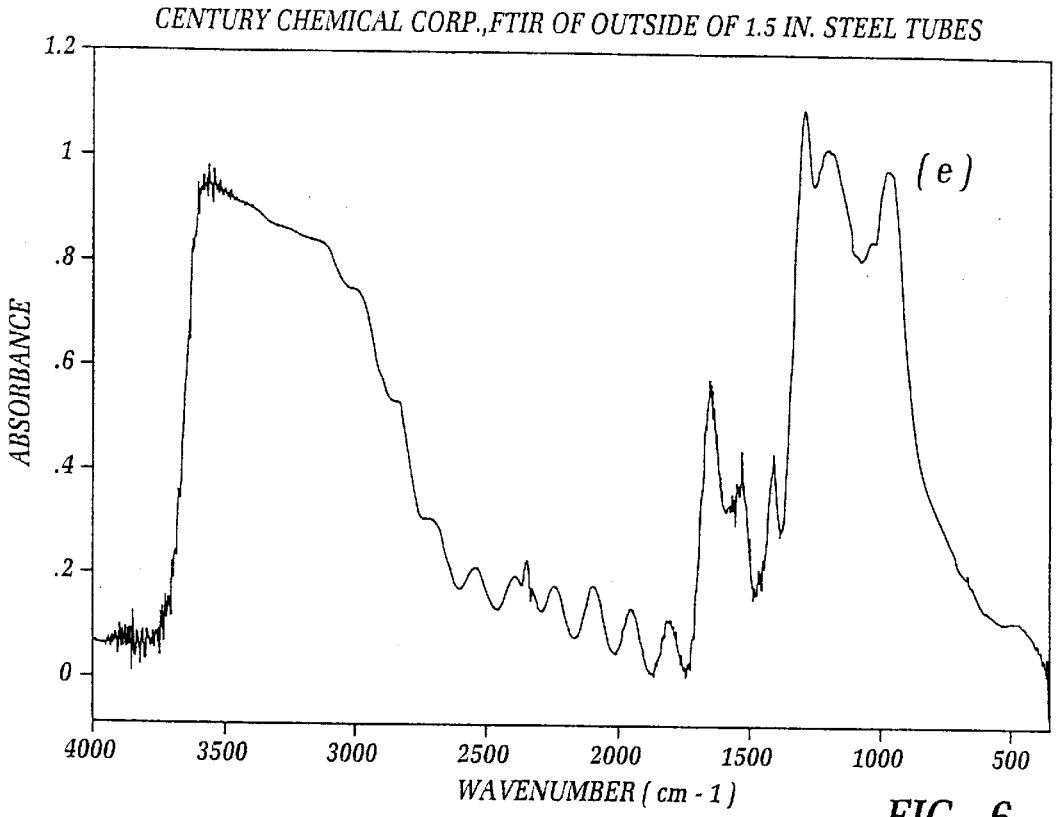
FIG. 6 is an F.T.I.R. spectra for tube e)
Figure 7:
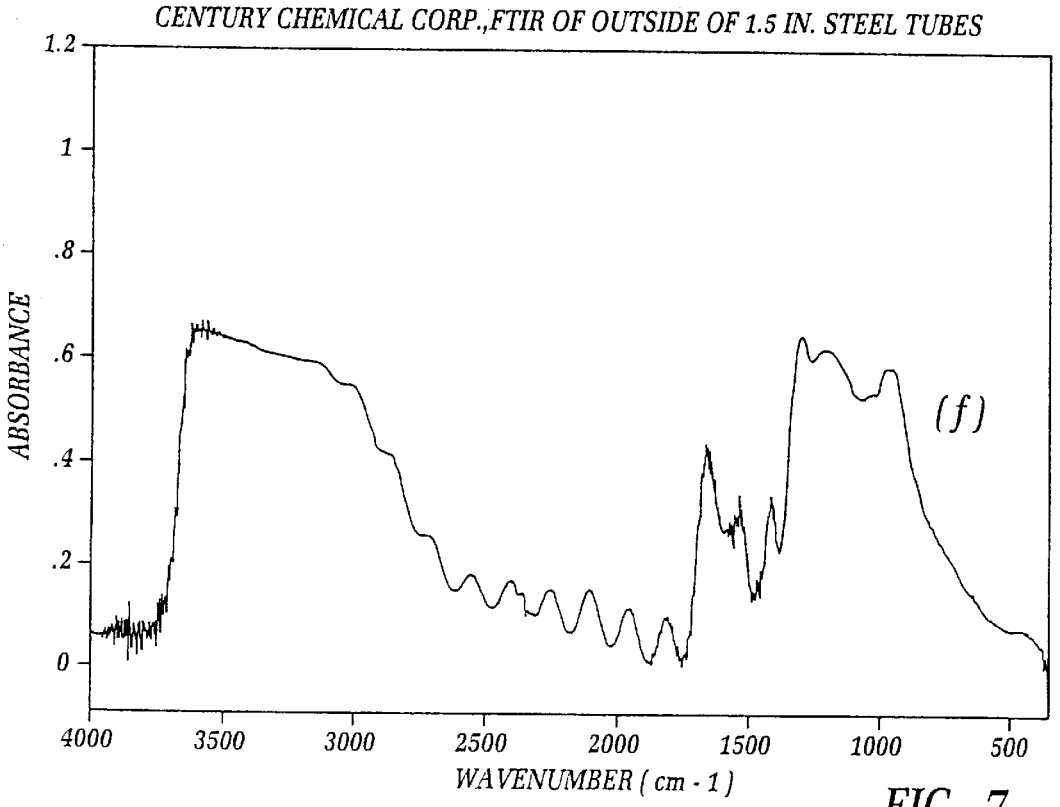
FIG. 7 is an F.T.I.R. spectra for tube f)

F.T.I.R. were run on tubing treated as in e) and in f) above. FIG. 6 is the spectra for tube e) and FIG. 7 is the spectra for tube f).

EXAMPLE 7

A combination coating-and-lubricating composition for use in the one-step process described hereinabove is prepared in the following manner.

Solubilizers

These ingredients are added first to heated water (150° F. to 185° F.) (or alternately to an existing lubricant, if desired), and allowed to dissolve and disperse for a minimum of about 30 minutes prior to the "solids" addition.

1. An organic dispersant, anionic in chemical affinity, polymeric in nature, of the general chemical family of carboxylated electrolytes.

One such product is Tamol 960, manufactured by Rohm and Haas, in Philadelphia, Pa. This component fills several roles: a) chemically disperses the insoluble components within the solution; b) promotes uniformity within the thickness of the coating; c) co-deposits with the other solution constituents, provides slip and high temperature film stability.

This is present in a range from about 15 to about 45 grams/Liter, with a preferred amount at about 30 grams/liter.

2. A hydrotrope and solubilizer, anionic in chemical affinity, of the phosphate ester chemical family.

One such product is RHODAFAC RA-600, manufactured by Rhone-Poulenc, in Marietta, Ga.

Its roles is as follows: this component reduces solution viscosity, thereby effectively thinning out the mixture and preventing random areas of heavy coating distribution. It further aids in the chemical dispersion of the insoluble stearate components.

This is present at a range from about 8 to about 20 grams/liter, with a preferred amount of about 12 grams/liter.

3. A secondary dispersant, hydrotrope, solubilizer and stabilizer, anionic in chemical affinity, present as a potassium salt of a phosphate ester.

One such product is Triton H-55, manufactured by Union Carbide, specialty chemicals in Danbury Conn.

This component provides chemical dispersion of the solids, prevents coagulation, further acts as a thinning agent and stabilizer to prevent a di-phase solution to develop.

This is present from a range of about 8 to about 20 grams/Liter, with a preferred embodiment of about 12 grams/Liter.

4. A dispersant, suspending agent, stabilizer, anionic in chemical affinity, in the family of sodium salts of naphthalene sulfonic acid.

One such product is Aerosol OS, manufactured by American Cyanamid (Cytec), in Wayne, N.J. This product is described in an American Cyanamid technical data sheet entitled "Aerosol OS Surfactant" dated June 1982; and in a Cytec MSDS therefor dated Jul. 1, 1997, both publications being incorporated herein by reference in their entirety.

Its role is to maintain solution stability among the soluble constituents and to provide dispersing and suspending action among the insoluble components. This ingredient does allow the solids to coagulate into a slurry, but aids in maintaining a uniform dispersion.

This is present from a range of about 2 to about 10 grams/Liter, with a preferred embodiment of about 4 grams/Liter.

5. A high molecular weight glycol wax, water dispersible at high temperatures in the chemical family of polyethylene glycols of 4000+ molecular weight.

One such wax is Carbowax Polyethylene Glycol (PEG) 4600, manufactured by Union carbide in Danbury Conn.

The role of this component is as follows: a) remain dispersed in solution and dry into a solid on the metal surface to be deformed—this becomes the bulk of the organic base which supports the characteristic mixture of insoluble solids; b) provide room temperature lubricity as the cold drawing operation begins; c) maintain the film after initial lubrication and forming and allow a residual lubricating film for re-forming if required.

This is present from a range of about 15 to about 45 grams/Liter, with a preferred embodiment of about 25 grams/Liter.

6. A glucose compound or derivative such as dextrose.

One such source of dextrose is 2001 Cerelose manufactured by Corn Products International in Englewood Cliffs, N.J.

The role of this component is two-fold: a) in solution, it acts as a solubilizer for several of the organic dispersants; b) in the coating, in conjunction with the meta-phosphate compound, it provides a thin coating (<1 gm/$M^2$) on ferrous surfaces as the initial layer of the lubricating film.

This is present from a range of about 4 to about 12 grams/Liter, with a preferred embodiment of about 6 grams/Liter.

7. A moderately alkaline phosphate compound, to provide 8–9 pH range stabilizing influence and linkage at the metal interface with the glucose compound.

One such component is Sodium Hexa Meta phosphate, manufactured by the Stauffer Chemical Co. division of Rhane-Poulenc in Shelton, Conn.

Its role is as follows: on ferrous surfaces, the nitrate oxidizes the very limited amount of ferrous iron present and allows it to re-deposit within the organo-phosphate layer.

This is present from a range of about 12 to about 24 grams/Liter, with a preferred embodiment of about 18 grams/ Liter.

8. An alkaline nitro compound to provide controlled oxidation at the metal interface, and allow the organo phosphate deposition.

One such compound is Sodium Nitrate, manufactured by Dupont in Cleveland, Ohio (MSDS Sheet by Genium Publishing, Schenectady, N.Y.).

Its role is as follows: on ferrous surfaces, the nitrate oxidizes the very limited amount of ferrous iron present and allows it to allows to re-deposit within the organo-phosphate layer.

This is present from a range of about 4 to about 12 grams/Liter, with a preferred embodiment of about 6 grams/Liter.

9. An optional de-foaming compound to control stearate soap foam both during mixing of the ingredients and during the processing of the tubes.

One such ingredient is Foam-ban MS 14M, manufactured by Ultra Additives in Paterson, N.J. This is described in the technical data sheet therefor dated Jan. 20, 1994, which is incorporated herein by reference in its entirety.

The role of this compound is as follows: this compound lays at the surface of the lubricant solution to break up soap bubbles as they form to prevent foam and froth. This is helpful during the initial charge of the bath and during replenishment additions, as well as to offset the foaming which occurs from the agitation and drainage of material being processed.

This is present from a range of about 2 to about 10 grams/Liter, with a preferred embodiment of 4 grams/Liter.

Solids

After the previous nine ingredients have been added and mixed into the water solution, these following stearate compounds, some of which will remain permanently insoluble as measurable and functional "solids," are added.

10. A saponified salt of palmetic and stearic acid.

One such salt is C-Lube 16, a proprietary product of Century Chemical, of Plainfield, Ill.

The role of this is a follows: a) it forms a stable emulsion within the solution; b) it contributes to the deposition of the organic base which acts as a carrier for the insoluble stearates; c) it provides lubricity for metal deformation from room temperature to about 240° F.

This component is present from a range of about 4 to about 12 grams/Liter, with a preferred embodiment of about 6 grams/Liter.

11. A saponified salt of high purity stearic acid.

One such salt is C-Lube 10, a proprietary product of Century Chemical, of Plainfield, Ill.

The role of this is a follows: a) it forms a stable emulsion within the solution; b) it contributes to the deposition of the organic base which acts as a carrier for the insoluble stearates; c) it provides lubricity for metal deformation from room temperature to about 270° F.

This component is present from a range of about 8 to about 24 grams/Liter, with a preferred embodiment of about 15 grams/Liter.

12. A water insoluble, metallic stearate salt with a melting point from 240° F. to 300° F.

One such salt is calcium stearate, manufactured by Witco Corporation in Houston, Tex.

Its role is as follows: a) it remains insoluble, but uniformly dispersed within the solution during processing and deposits within the wax and soap film; b) it slowly melts and lubricates as the metal temperature rises rapidly during metal deformation; c) it provides lubrication at all temperatures during metal deformation from ambient up to its liquidus point.

This component is present from a range of about 24 to about 48 grams/Liter, with a preferred embodiment of about 32 grams/Liter.

13. A water insoluble, metallic stearate salt with a melting point from 270° F. to 320° F.

One such salt is Magnesium Stearate NF, manufactured by Witco Corporation in Greenwich, Conn. This is described in the Certificate of Analysis Batch No. 117884 therefor dated Dec. 30, 1999, and in the MSDS therefor dated Aug. 15, 1994, both publications being incorporated herein by reference in their entirety.

Its role is as follows: a) it remains insoluble, but uniformly dispersed within the solution during processing and deposits within the wax and soap film; b) it slowly melts and lubricates as the metal temperature rises rapidly during metal deformation; c) it provides lubrication at all temperatures during metal deformation from ambient up to its liquidus point.

This component is present from a range of about 22 to about 44 grams/Liter, with a preferred embodiment of 30 grams/Liter.

14. A water insoluble, metallic stearate salt with a melting point from 320° F. to 400° F.

One such salt is lithium stearate, manufactured by Witco Corporation in Houston, Tex.

Its role is as follows: a) it remains insoluble, but uniformly dispersed within the solution during processing and deposits within the wax and soap film; b) it slowly melts and lubricates as the metal temperature rises rapidly during metal deformation; c) it provides lubrication at all temperatures during metal deformation from ambient up to its liquidus point.

This component is present from a range of about 24 to about 48 grams/Liter, with a preferred embodiment of about 32 grams/Liter.

These fourteen components form a homogeneous suspension whereby each ingredient can act both independently and synergistically with the others. The solution appears as a milky white emulsion and requires agitation to ensure that it remains characteristic.

While preferred embodiments of the invention have been described in detail, it will be apparent to those skilled in the art that the disclosed embodiments may be modified. Therefore, the foregoing description is to be considered exemplary rather than limiting, and the true scope of the invention is that defined in the following claims.

What is claimed is:

1. A composition for depositing an organic conversion coating on a metal workpiece prior to or simultaneous with lubrication and prior to cold forming, the coating composition consisting essentially of:

at least one glucose derivative present in an amount sufficient to form a loose, soft and pliable layer of powdery crystals;

at least one meta-phosphate compound present in an amount sufficient to provide linkage from the organic layer to the metal surface; and a source of nitrate/nitrite in the form of metallic or alkali earth compounds, in an amount sufficient to provide limited acceleration for the organic deposit.

2. The composition as defined in claim 1, further consisting essentially of at least one anionic surfactant present in an amount sufficient to provide wetting and drainage characteristics to the composition.

3. A composition for lubricating a metal workpiece prior to cold forming, the composition consisting essentially of:

at least one aqueous alkaline stearate compound adapted to, and present in an amount sufficient to impart metal lubrication between about 180° F. and about 320° F.;

at least one aqueous alkaline palmitate compound adapted to, and present in an amount sufficient to impart metal lubrication below about 160° F.;

at least one aqueous metallic stearate compound adapted to, and present in an amount sufficient to impart metal lubrication between about 240° F. and 320° F.;

at least one polymeric glycol adapted to, and present in an amount sufficient to provide temperature stability, act as a carrier for the aqueous compounds, and impart a waxy lubrication to the metal;

at least one hydrotropic agent adapted to, and present in an amount sufficient to solubilize the lubricating composition; and at least one stabilizing agent adapted to, and present in an amount sufficient to maintain solution stability among soluble constituents and to provide dispersing and suspending action among insoluble constituents, wherein the at least one stabilizing agent is from the chemical family of naphthalene sulfonic acids.

4. The lubricating composition as defined in claim 3, further consisting essentially of:

a dispersing agent for maintaining the aqueous compounds in solution; and a polyelectrolyte for imparting a cohesive film strength to the lubricating composition as it is dried on the metal workpiece.

5. The lubricating composition as defined in claim 4 wherein the dispersing agent and the polyelectrolyte are a sodium salt of a carboxylated acrylic polyelectrolyte.

6. A composition for lubricating a metal workpiece prior to cold forming, the composition consisting essentially of:

at least one aqueous alkaline stearate compound adapted to, and present in an amount sufficient to impart metal lubrication between about 180° F. and about 320° F.;

at least one aqueous alkaline palmitate compound adapted to, and present in an amount sufficient to impart metal lubrication below about 160° F.;

at least one aqueous metallic stearate compound adapted to, and present in an amount sufficient to impart metal lubrication between about 240° F. and 320° F.;

at least one polymeric glycol adapted to, and present in an amount sufficient to provide temperature stability, act as a carrier for the aqueous compounds, and impart a waxy lubrication to the metal;

at least one hydrotropic agent adapted to, and present in an amount sufficient to solubilize the lubricating composition;

at least one stabilizing agent adapted to, and present in an amount sufficient to maintain solution stability among soluble constituents and to provide dispersing and suspending action among insoluble constituents; and a de-foaming agent adapted to, and present in an amount sufficient to lay at the surface of the lubricating composition to break up soap bubbles as they form and to prevent foam and froth.

7. A process for lubricating a metal workpiece outer surface prior to cold forming, the process comprising the step of:

disposing a non-reactive lubricating composition on the workpiece outer surface, the outer surface having been cleaned and rinsed, the lubricating composition consisting essentially of:

at least one aqueous alkaline stearate compound adapted to, and present in an amount sufficient to impart metal lubrication between about 180° F. and about 320° F.;

at least one aqueous alkaline palmitate compound adapted to, and present in an amount sufficient to impart metal lubrication below about 160° F.;

at least one aqueous metallic stearate compound adapted to, and present in an amount sufficient to impart metal lubrication between about 240° F. and 320° F.;

at least one polymeric glycol adapted to, and present in an amount sufficient to provide temperature stability, act as a carrier for the aqueous compounds, and impart a waxy lubrication to the metal;

at least one hydrotropic agent adapted to, and present in an amount sufficient to solubilize the lubricating composition; and at least one stabilizing agent adapted to, and present in an amount sufficient to maintain solution stability among soluble constituents and to provide dispersing and suspending action among insoluble constituents, wherein the at least one stabilizing agent is from the chemical family of naphthalene sulfonic acids.

8. The process as defined in claim 7 wherein the lubricating composition further consists essentially of:

a dispersing agent for maintaining the aqueous compounds in solution; and a polyelectrolyte for imparting a cohesive film strength to the lubricating composition as it is dried on the metal workpiece.

9. The process as defined in claim 8 wherein the lubricating composition further consists essentially of a de-foaming agent adapted to, and present in an amount sufficient to lay at the surface of the lubricating composition to break up soap bubbles as they form and to prevent foam and froth.

10. A process for lubricating a metal workpiece outer surface prior to cold forming, the process comprising the step of:

disposing a non-reactive lubricating composition on the workpiece outer surface, the outer surface having been cleaned and rinsed, the lubricating composition consisting essentially of:

at least one aqueous alkaline stearate compound adapted to, and present in an amount sufficient to impart metal lubrication between about 180° F. and about 320° F.;

at least one aqueous alkaline palmitate compound adapted to, and present in an amount sufficient to impart metal lubrication below about 160° F.;

at least one aqueous metallic stearate compound adapted to, and present in an amount sufficient to impart metal lubrication between about 240° F. and 320° F.;

at least one polymeric glycol adapted to, and present in an amount sufficient to provide temperature stability, act as a carrier for the aqueous compounds, and impart a waxy lubrication to the metal;

at least one hydrotropic agent adapted to, and present in an amount sufficient to solubilize the lubricating composition; and at least one stabilizing agent adapted to, and present in an amount sufficient to maintain solution stability among soluble constituents and to provide dispersing and suspending action among insoluble constituents;

wherein before the lubricating composition is disposed on the workpiece outer surface, the process further comprises the step of applying an organic conversion coating composition to the surface, and wherein the coating composition consists essentially of:

at least one glucose derivative present in an amount sufficient to form a loose, soft and pliable layer of powdery crystals;

at least one meta-phosphate compound present in an amount sufficient to provide linkage from the organic layer to the metal surface; and a source of nitrate/nitrite in the form of metallic or alkali earth compounds, in an amount sufficient to provide limited acceleration for the organic deposit.

11. A process for lubricating a metal workpiece outer surface prior to cold forming, the process comprising the step of:

disposing a non-reactive lubricating composition on the workpiece outer surface, the outer surface having been cleaned and rinsed, the lubricating composition consisting essentially of:

at least one aqueous alkaline stearate compound adapted to, and present in an amount sufficient to impart metal lubrication between about 180° F. and about 320° F.;

at least one aqueous alkaline palmitate compound adapted to, and present in an amount sufficient to impart metal lubrication below about 160° F.;

at least one aqueous metallic stearate compound adapted to, and present in an amount sufficient to impart metal lubrication between about 240° F. and 320° F.;

at least one polymeric glycol adapted to, and present in an amount sufficient to provide temperature stability, act as a carrier for the aqueous compounds, and impart a waxy lubrication to the metal;

at least one hydrotropic agent adapted to, and present in an amount sufficient to solubilize the lubricating composition; and at least one stabilizing agent adapted to, and present in an amount sufficient to maintain solution stability among soluble constituents and to provide dispersing and suspending action among insoluble constituents;

wherein simultaneous with the lubricating composition being disposed on the workpiece outer surface, the process further comprises the step of applying an organic conversion coating composition to the surface, and wherein the coating composition consists essentially of:

at least one glucose derivative present in an amount sufficient to form a loose, soft and pliable layer of powdery crystals;

at least one meta-phosphate compound present in an amount sufficient to provide linkage from the organic layer to the metal surface; and a source of nitrate/nitrite in the form of metallic or alkali earth compounds, in an amount sufficient to provide limited acceleration for the organic deposit.

12. The composition as defined in claim 1 wherein the glucose derivative is dextrose and is present in an amount ranging between about 70 grams/liter to about 125 grams/Liter.

13. The composition as defined in claim 1 wherein the meta-phosphate compound is sodium hexa-meta phosphate and is present in an amount ranging from about 60 grams/liter to about 140 grams/liter.

14. The composition as defined in claim 1 wherein the source of nitrate/nitrite is sodium nitrate and is present in an amount ranging from about 12 grams/liter to about 32 grams/liter.

15. A composition for depositing an organic conversion coating on a metal workpiece prior to or simultaneous with lubrication and prior to cold forming, the coating composition consisting essentially of:

at least one glucose derivative present in an amount sufficient to form a loose, soft and pliable layer of powdery crystals, wherein the glucose derivative is dextrose and is present in an amount ranging between about 70 grams/liter to about 125 grams/Liter;

at least one meta-phosphate compound present in an amount sufficient to provide linkage from the organic layer to the metal surface, wherein the meta-phosphate compound is sodium hexa-meta phosphate and is present in an amount ranging from about 60 grams/liter to about 140 grams/liter; and a source of nitrate/nitrite in the form of metallic or alkali earth compounds, in an amount sufficient to provide limited acceleration for the organic deposit, wherein the source of nitrate/nitrite is sodium nitrate and is present in an amount ranging from about 12 grams/liter to about 32 grams/liter.

16. A composition for depositing an organic conversion coating on a metal workpiece prior to or simultaneous with lubrication and prior to cold forming, the coating composition consisting essentially of:

at least one glucose derivative present in an amount sufficient to form a loose, soft and pliable layer of powdery crystals; and at least one meta-phosphate compound present in an amount sufficient to provide linkage from the organic layer to the metal surface.

17. The composition as defined in claim 16 wherein the glucose derivative is dextrose and is present in an amount ranging between about 70 grams/liter to about 125 grams/Liter.

18. The composition as defined in claim 16 wherein the meta-phosphate compound is sodium hexa-meta phosphate and is present in an amount ranging from about 60 grams/liter to about 140 grams/liter.

19. The composition as defined in claim 1 wherein a lubricating composition for achieving the metal workpiece lubrication consists essentially of:

at least one aqueous alkaline stearate compound adapted to, and present in an amount sufficient to impart metal lubrication between about 180° F. and about 320° F.;

at least one aqueous alkaline palmitate compound adapted to, and present in an amount sufficient to impart metal lubrication below about 160° F.;

at least one aqueous metallic stearate compound adapted to, and present in an amount sufficient to impart metal lubrication between about 240° F. and 320° F.;

at least one polymeric glycol adapted to, and present in an amount sufficient to provide temperature stability, act as a carrier for the aqueous compounds, and impart a waxy lubrication to the metal;

at least one hydrotropic agent adapted to, and present in an amount sufficient to solubilize the lubricating composition; and at least one stabilizing agent adapted to, and present in an amount sufficient to maintain solution stability among soluble constituents and to provide dispersing and suspending action among insoluble constituents.

20. The composition as defined in claim 19 wherein the at least one hydrotropic agent in the lubricating composition is from the chemical family of phosphate esters and is present in an amount ranging between about 5 grams/liter and about 24 grams/liter.

21. The composition as defined in claim 19 wherein the at least one stabilizing agent in the lubricating composition is from the chemical family of naphthalene sulfonic acids and is present in an amount ranging between about 2 grams/liter to about 10 grams/Liter.

22. The composition as defined in claim 19 wherein the lubricating composition further consists essentially of a de-foaming agent adapted to, and present in an amount sufficient to lay at the surface of the lubricating composition to break up soap bubbles as they form and to prevent foam and froth.

23. The composition as defined in claim 19 wherein the lubricating composition further consists essentially of:

a dispersing agent for maintaining the aqueous compounds in solution; and a polyelectrolyte for imparting a cohesive film strength to the lubricating composition as it is dried on the metal workpiece.

24. The composition as defined in claim 23 wherein the dispersing agent and the polyelectrolyte in the lubricating composition are from the chemical family of carboxylated acrylic polyelectrolytes.

25. The composition as defined in claim 24 wherein the carboxylated acrylic polyelectrolytes are present in an amount ranging between about 0.25 grams/liter and about 45 grams/liter.

26. The composition as defined in claim 25 wherein the carboxylated acrylic polyelectrolytes are present in an amount ranging between about 8 grams/liter and about 30 grams/liter.

27. The composition as defined in claim 19 wherein the at least one polymeric glycol in the lubricating composition is present in an amount ranging between about 10 grams/liter and about 45 grams/liter.

28. The composition as defined in claim 27 wherein the at least one polymeric glycol in the lubricating composition is present in an amount ranging between about 15 grams/liter and about 30 grams/liter.

29. A composition for lubricating a metal workpiece prior to cold forming, the composition consisting of:

at least one aqueous alkaline stearate compound adapted to, and present in an amount sufficient to impart metal lubrication between about 180° F. and about 320° F.;

at least one aqueous alkaline palmitate compound adapted to, and present in an amount sufficient to impart metal lubrication below about 160° F.;

at least one aqueous alkaline stearate compound adapted to, and present in an amount sufficient to impart metal lubrication between about 240° F. and 320° F.;

at least one polymeric glycol adapted to, and present in an amount sufficient to provide temperature stability, act as a carrier for the aqueous compounds, and impart a waxy lubrication to the metal;

at least one hydrotropic agent adapted to, and present in an amount sufficient to solubilize the lubricating composition;

at least one stabilizing agent adapted to, and present in an amount sufficient to maintain solution stability among soluble constituents and to provide dispersing and suspending action among insoluble constituents; and a dispersing agent/polyelectrolyte for maintaining the aqueous compounds in solution and for imparting a cohesive film strength to the lubricating composition as it is dried on the metal workpiece.

* * * * *